US005564591A

United States Patent [19]

Christine et al.

[11] Patent Number: 5,564,591

[45] Date of Patent: Oct. 15, 1996

[54] BEVERAGE CONTAINER HAVING SEALED INTEGRAL DISPENSING MEANS

[75] Inventors: William C. Christine, Nazareth; Scott A. Roth, Coplay; Joy M. Caspers, Bangor, all of Pa.

[73] Assignee: Inpaco Corporation, Nazareth, Pa.

[21] Appl. No.: 201,622

[22] Filed: Feb. 25, 1994

[51] Int. Cl.[6] ..... B65D 25/00

[52] U.S. Cl. ..... 220/705; 220/710; 222/211; 383/80

[58] Field of Search ..... 220/705, 710; 215/1 A, 1 C; 383/906, 100, 80; 222/211, 212; 229/103.1

[56] References Cited

U.S. PATENT DOCUMENTS

| | | | |
|---|---|---|---|
| 3,342,326 | 9/1967 | Zackheim | 222/211 |
| 3,583,460 | 6/1971 | Faust et al. | 383/80 X |
| 4,411,359 | 10/1983 | Franco | 215/1 A X |
| 4,718,778 | 1/1988 | Ichikawa | 220/705 X |
| 5,054,631 | 10/1991 | Robbins, III | 220/710 X |
| 5,116,105 | 5/1992 | Hong | 220/710 X |
| 5,188,283 | 2/1993 | Gu | 229/103.1 |
| 5,366,296 | 11/1994 | Stenstrom et al. | 383/906 X |

*Primary Examiner*—Steven M. Pollard
*Attorney, Agent, or Firm*—Vorys, Sater, Seymour & Pease

[57] ABSTRACT

A container for housing and dispensing a beverage. The container having a body with a top, a bottom and gussetted sides. The body is defined by flexible walls defining a chamber. The body further has a first tab and a second tab disposed at the top. A fitment is sealed to the body. A drink tube integral to the fitment extends from the fitment into the body.

19 Claims, 7 Drawing Sheets

BEVERAGE CONTAINER HAVING SEALED INTEGRAL DISPENSING MEANS

BACKGROUND OF THE INVENTION

The present invention relates generally to beverage containers. More specifically, the present invention relates to a beverage container having a sealed, integral dispensing means and a method for making same.

Containers that store a beverage and provide a means for dispensing the beverage are known in the art. For example, a commonly-used beverage container is a drink box with an additional drinking straw provided for insertion into the box to dispense the beverage. Also known in the art are pouches or bags that contain beverages for drinking.

These drink boxes and beverage pouches are quite popular due to their convenience, portability and capability for sanitary storage of beverages. For example, drink boxes, because of their individual-size portions and portable nature, have become commonplace in children's school lunches and for many "brown bag" lunch carriers.

However, the known containers have some deficiencies. For example, many of the known drink boxes come with an accompanying straw that must be punctured through the drink box itself to provide a means for dispensing the beverage. This can be problematic. Such a task may be unsafe and difficult for a child to perform, since the straw necessarily has a sharp edge to puncture through the cardboard drink box and such a task requires a degree of manual dexterity beyond normal abilities of a young child.

Furthermore, the straw is usually fastened to the drink box by an adhesive on the box itself, which requires another processing step in the manufacture thereof. Also, another problem known in the art is that the straw could become separated from the drink box, thereby rendering the drink box unusable. In addition, it is sometimes difficult to find the puncture hole for inserting the straw.

In addition to the physical problems of the known drink boxes and beverage pouches are problems related to cost. Also, related manufacturing problems are involved therewith. The known drink boxes are folded from modified paper stock. This can be problematic. For example, it is inherently more difficult to form a square box than a somewhat less structured pouch. Also, the paper stock can become more expensive when all the modifications to provide essential barrier properties are added. Thus, the use of a material that inherently provides a vapor barrier and that is heat-sealable provides for lower cost and more cost-effective manufacturing.

Many of the same problems associated with the drink boxes are present with the beverage pouches, too. Thus, the problems associated with known drink boxes and beverage pouches need correction in a simple and cost-effective manner.

As a result, there is therefore a need for an improved, portable, individual beverage container having a sealed, integral dispensing means and an efficient and cost-effective manner of manufacturing same.

SUMMARY OF THE INVENTION

The present invention provides a container for housing and dispensing a beverage having a body with a top, a bottom and gussetted sides, the body being defined by flexible walls defining a chamber. The body also has a first tab and a second tab disposed at the top, a fitment sealed to the top of the body, and a drink tube extending from the fitment down into the body.

The present invention further provides a container for housing and dispensing a beverage having a body with a top, a bottom and gussetted sides, the body being defined by flexible walls defining a chamber for housing the beverage, a fitment sealed to the top of the body such that the body further comprises a means for opening the fitment, and a drink tube extending from the fitment into the chamber of the body.

In an embodiment, the present invention provides a container having a body constructed from a material selected from the group consisting of a foil or polymeric films.

In an embodiment, the beverage container has a body constructed from pre-printed rolls of polymeric film.

In an embodiment, the beverage container is constructed from a film having an additive that provides strength to the container. The additive can be selected from the group consisting of: polyester, polyolefins and polyamide.

In an embodiment, the beverage container provides a fitment that is injection molded.

In an embodiment, the beverage container provides a fitment that is heat sealed to the body.

In an embodiment, the beverage container provides a fitment having means for opening the fitment to permit fluid flow of the beverage from the body via the drink tube and the fitment after opening.

In an embodiment, the beverage container provides a fitment having energy-directing sealing ridges to prevent the fitment from being separated from the body after heat sealing the fitment to the body.

An advantage of the present invention is that it provides a beverage container that reduces manufacturing costs by providing the capability for high volume, highly automated production.

Another advantage of the present invention is that it provides an improved container for housing various beverages.

A further advantage of the present invention is that it provides a beverage container having improved handling characteristics.

Moreover, an advantage of the present invention is that is provides a beverage container that largely reduces the known problems of existing containers with respect to dispensing a beverage.

Another advantage of the present invention is that it provides a beverage container with improved labeling methods for easier manufacturing.

Further, an advantage of the present invention is that it provides a beverage container that is largely recyclable.

Also, an advantage of the present container is that it provides a beverage container that is fully self-contained.

Yet another advantage of the present invention is that it provides a beverage container that is sanitary and unitary in that it has only one sealed unit with three components.

An additional advantage of the present invention is that it provides a beverage container that is convenient and portable.

An advantage of the present invention is that it provides a beverage container having simple construction.

A further advantage of the present invention is that it provides a beverage container that is easily operated by children having limited motor skills.

An added advantage of the present invention is that it provides a beverage container having a self-opening dispensing means.

In addition, an advantage of the present invention is that it provides a beverage container with an easy peel opening means having uneven tabs for simple operation.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a beverage container having a sealed and integral dispensing means and method for manufacturing same. The beverage container is preferably suited for use with "still" or non-carbonated beverages.

Figure 1:
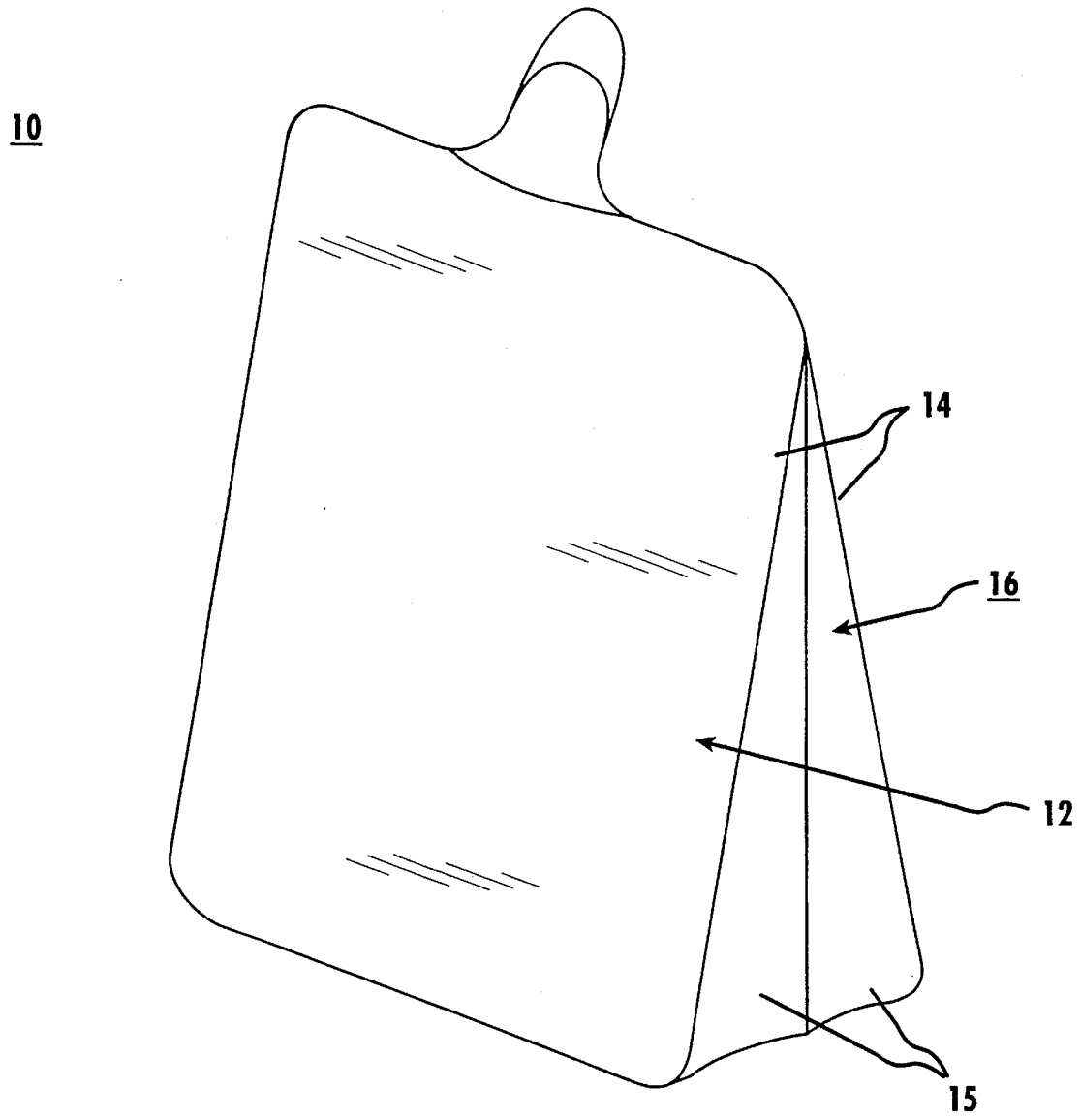
FIG. 1 illustrates a perspective view of a container of the present invention.

FIG. 1 illustrates a perspective view of a beverage container 10 of the present invention. As illustrated, the beverage container 10 comprises a body 12 having flexible walls 14 that are sturdy enough to enable the container 10 to stand up under its own strength of construction.

To this end, the material must have enough structural strength so that the beverage container 10 can stand up by virtue of its own construction. The container 10 is preferably formed from a flexible plastic film. In constructing the container 10, many polymer materials can be used that are heat sealable. Such materials include, for example, polyolefine. Therefore, the material must be sturdy enough to stand up and might therefore require an additive of polyester or polyamide to be put into the material for extra strength. Also, for example, nylon could be used as an additive in the film material to provide structural strength. A further additive material could also be polypropylene.

In addition to the container material selected, the physical design of the container 10 can be optimized for added standing strength. As illustrated in FIG. 1, the container 10 preferably has walls 14 and gussets 15 formed in sidewalls 16. These gussets 15 are in practice, folds which contribute to the strength of the container 10 and provide the capability for the container 10 to be free-standing.

In addition, other factors must be considered when selecting the appropriate and preferred material for construction of the beverage container 10. For example, one consideration is the type of beverage to be stored.

For example, the walls 14 are constructed from material which depends upon the type of beverage to be stored within the beverage container 10. For example, a preferable material is a flexible plastic film. The type of film chosen, however, depends upon the barrier required for a particular beverage. Also, the barrier requirements may include the fact that certain beverages need reduced oxygen permeation, for example, drinks having a high fruit content. To this end, when storing a high fruit-content drink, a preferable material to be used for the container 10 is a type of foil or an EVOH material.

Thus, the plastic film material selected must be of a type that provides strength and barrier. In addition, the material must be heat-sealable to provide for cost-effective construction of the container 10.

An additional factor to consider when selecting the container material is the labeling of the beverage container 10. The material chosen should be conducive to screen printing or other simple, low-cost technique for the printing of labeling and other information (i.e. nutritional labels), on the plastic film itself, prior to construction of the beverage container 10. The capability to use preprinted film provides several cost and efficiency benefits in the construction of the present invention. For example, many difficulties arise when trying to label or print on an irregular-shaped object. The printing can distort and thereby destroy the appearance of the object. Thus, a flat sheet of film, as preferably used in the present invention, provides an ideal medium for various types of printing.

Figure 2:
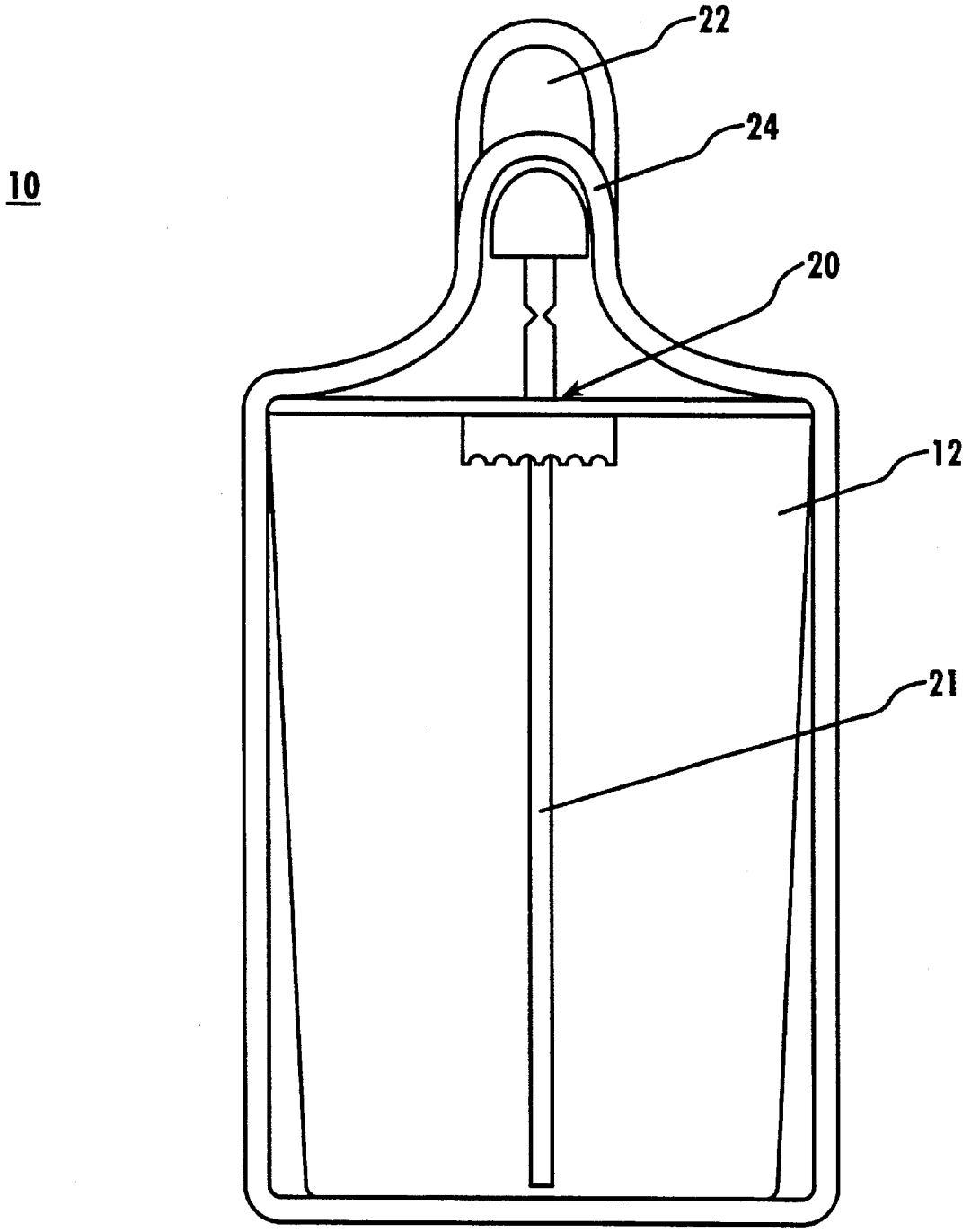
FIG. 2 illustrates a cut-away front view of the present invention.

FIG. 2 illustrates a cut-away front view of the present invention. Although the beverage container 10 is preferably opaque, an embodiment of a fitment 20 and a drink tube 21 are also shown in this cut-away figure. As can be seen at the top of FIG. 2, an embodiment of the container 10 is provided with a long pull tab 22 and a short pull tab 24 for opening the container 10 to access the fitment 20 and drink tube 21.

Figure 3:
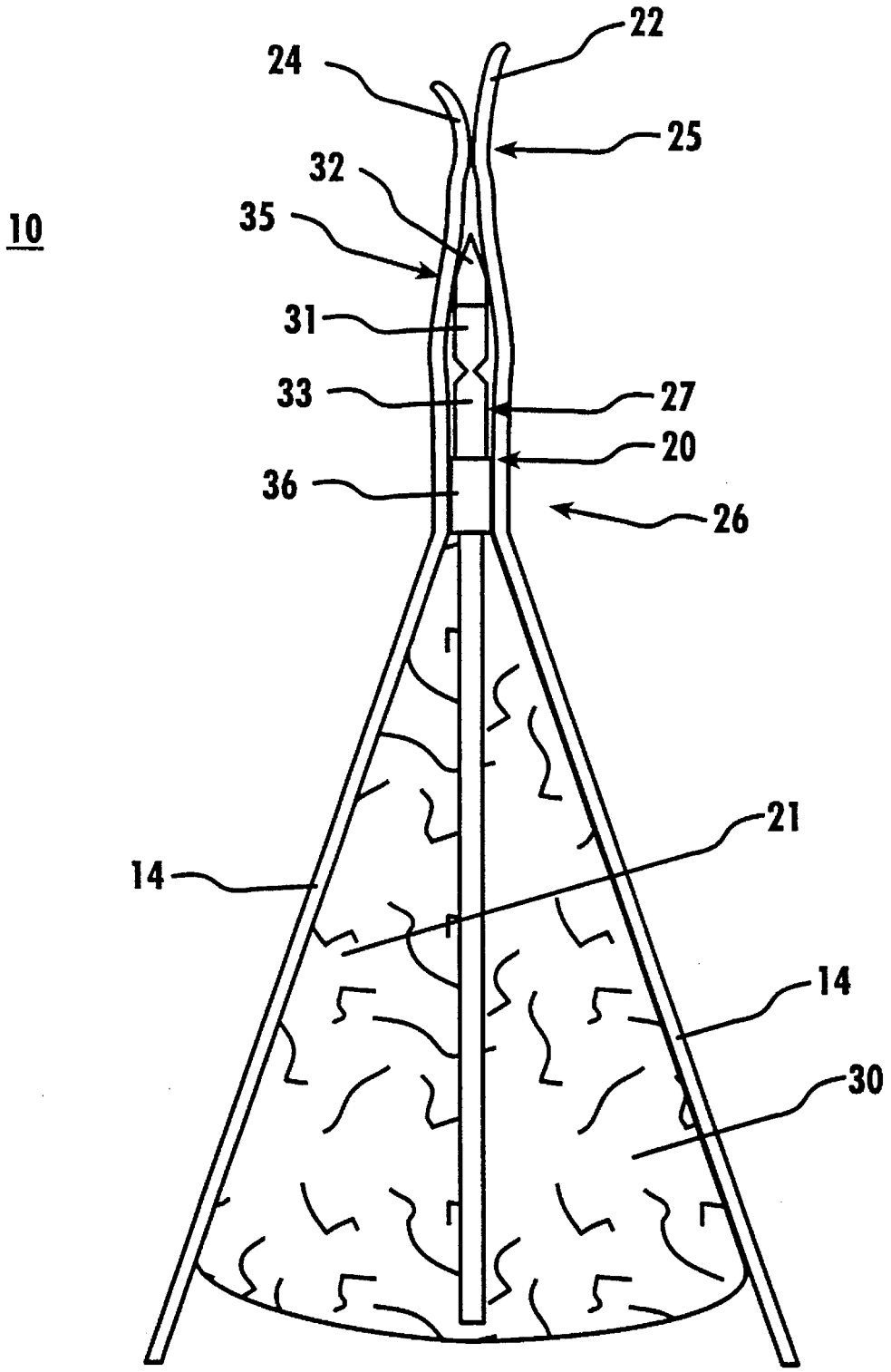
FIG. 3 illustrates a side view of the present invention.

FIG. 3 illustrates a side section view of the present invention. As illustrated, the uneven tabs 22, 24 provided for easy grasping by a user are located at the top of the container 10. As illustrated, a peelable seal 25 is disposed above the fitment 20. Also, a fusion seal 26, preferably hermetic, is used to connect the fitment 20 to the walls 14. The peelable seal 25 and the fusion seal 26 thereby form an enclosure 27 surrounding the fitment 20. Thus, the fitment 20 is housed in the air-tight, sanitary enclosure 27. A beverage 30 is stored within the lower portion of the container 10. Also illustrated are the gussets 15 in the sidewalls 16 for extra standing strength. Further illustrated is the drink tube 21 which is connected to the fitment 20 and extends down to the bottom of the beverage container 10. Those skilled in the art would, of course, recognize that the drink tube 21 could have various lengths. Also, an embodiment of the container 10 is possible without having a drink tube 21 at all. In such an embodiment, the liquid beverage 30 could be dispensed by squeezing the body 12 to propel the beverage 30 through the fitment 20. Also, the container 10 could be inverted to dispense the beverage 30 by gravity flow.

Figure 4:
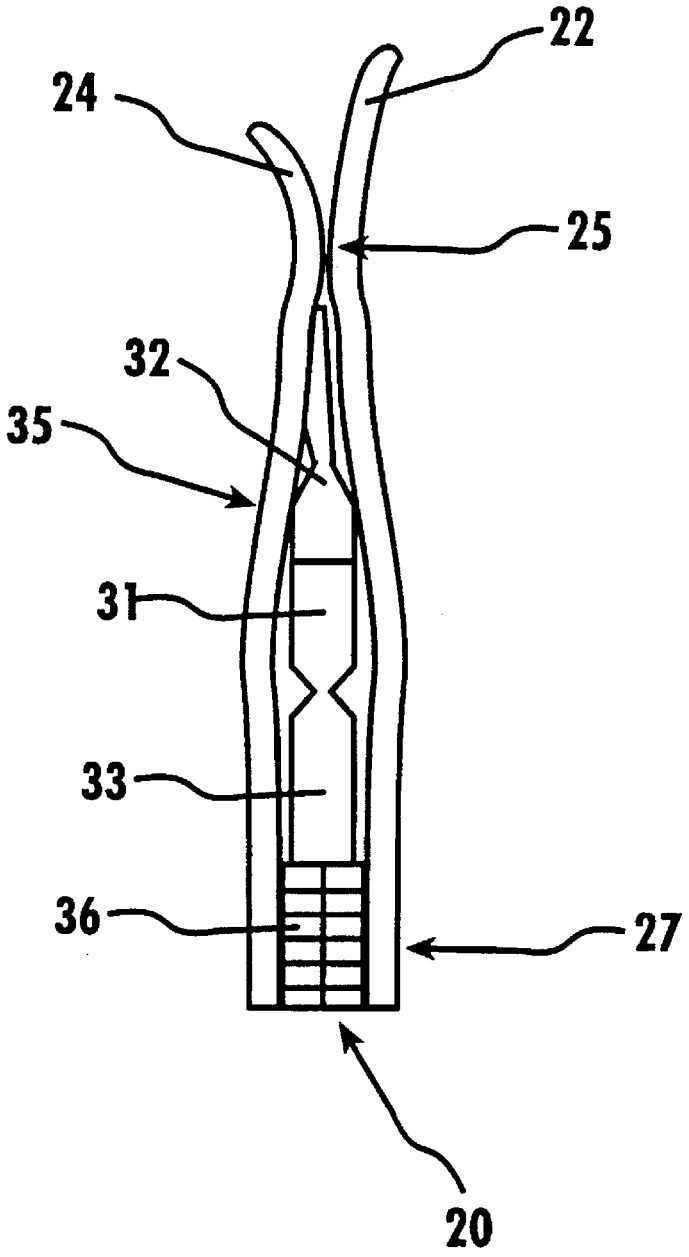
FIG. 4 illustrates a side view of a detail of the top portion of the present invention.

FIG. 4 illustrates a side view of a detail of the top portion of the present invention. As can be seen, the long tab 22 and the short tab 24 are sealed together above the drink tube 21 and the fitment 20. This seal 25 is a peelable one, not a fusion seal. However, a fusion seal 35 seals the long tab 22 to a break-off end tab 32 of a break-off end 31 of the fitment 20. The break-off end tab 32 is fusion sealed only to the long tab 22.

Figure 5A:
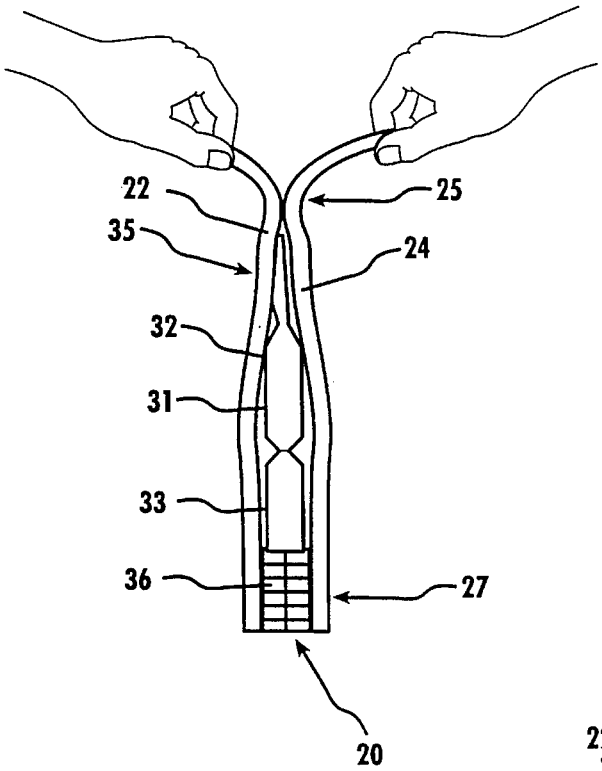
FIG. 5*a* illustrates a pull-tab portion of the present invention.

An illustration of the tabs 22, 24 and the break-off end 31 is provided. Specifically, FIG. 5*a* illustrates an embodiment of a pull tab portion of the present invention. As illustrated, a user grabs the short tab 24 in one hand and the long tab 22 in the other and pulls the peelable seal 25 apart to open the enclosure 27. This operation is done simply since the tabs 22, 24 are of unequal length. Thus, because of the difference in length of the tabs, no difficulty arises in trying to separate the two tabs 22, 24 of film.

Figure 5B:
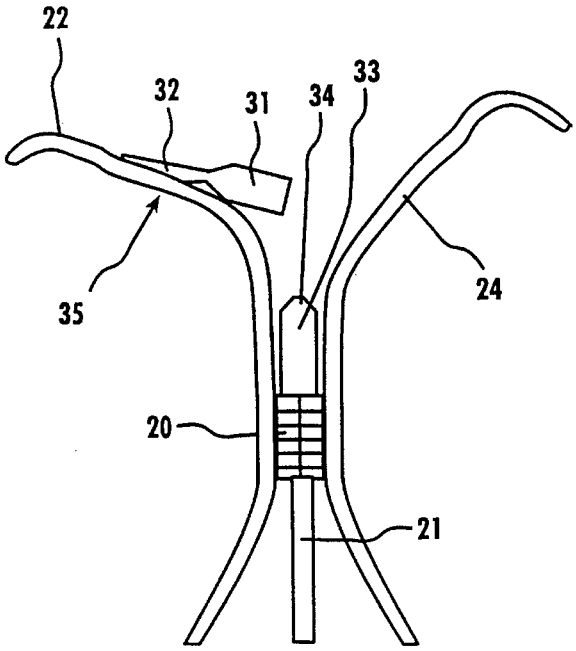
FIG. 5*b* illustrates the pull-tab portion of the present invention after operation of the pull-tab of the present invention.

FIG. 5*b* illustrates an embodiment of the pull tab portion of the present invention after the opening operation begun in FIG. 5*a*. As the user pulls the tabs 22, 24 apart, the break-off end 31 having the break-off end tab 32 automatically breaks away from a sipper 33 of the fitment 20 at a separation point 34. The break-off end tab 32 has a fusion seal 35 connecting it to the long tab 22. Since the break-off end tab 32 is sealed to only one of the tabs, preferably the long tab 22, the tabs 22, 24 are able to fully separate from one another thereby opening the enclosure 27 to expose the sipper 33 of the fitment 20. Also, the separated break-off end 31 opens the fitment 20 at the separation point 34, thereby providing an opening in the sipper 33 for dispensing the beverage 30. The separated tabs 22, 24 provide an open container 10, an accessible drink tube 21, while the break-off end tab 32 remains fused to the long tab 22. Thus, the break-off end 31 and the break-off end tab 32 are separated from the fitment 20 and yet remain on the long tab 22 so as not to cause any loose refuse material as a result of opening the container 10.

Figure 6A:
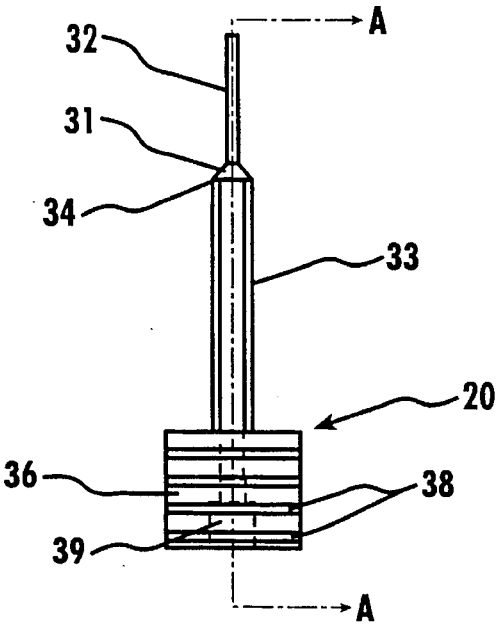
FIG. 6*a* illustrates a side view of a fitment of the present invention.
Figure 6B:
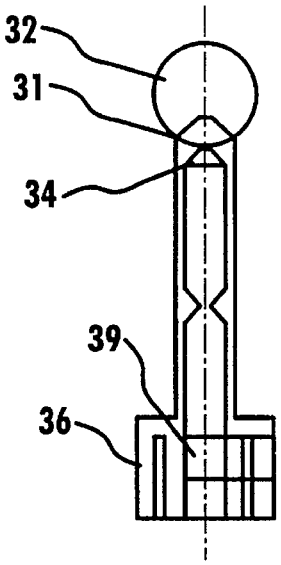
FIG. 6*b* illustrates a side section view taken along section line A—A of FIG. 6*a* of a fitment of the present invention.

Now referring to more detailed views of the fitment 20, FIG. 6*a* illustrates a side view. FIG. 6*b* illustrates a side section view of the fitment 20 of the present invention taken along section line A—A of FIG. 6*a*. As can be seen, the break-off end 31 is located at the top of the fitment 20 and at the separation point 34 on the fitment 20 itself. This separation point 34 subsequently forms the top of the sipper 33, which is connected to the drink tube 21 via the fitment 20. Also illustrated is a fitment base 36 which attaches to the film of the beverage container 10 by the fusion heat seal 26. This fusion seal 26 is preferably hermetic. Also illustrated are further components of the fitment 20. For example, energy-directing sealing ridges 38 are provided on the fitment base 36 to enable better contact of the beverage container 10 to the fitment 20. These ridges 38 also help to prevent the fitment 20 from separating from the body 12 of the container 10.

Figure 6C:
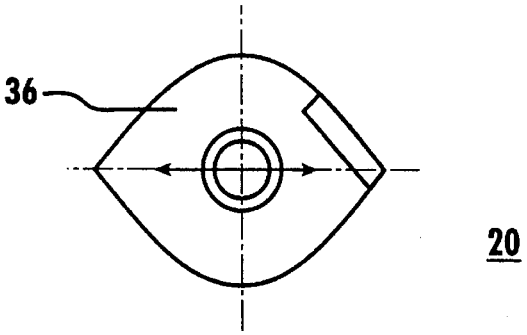
FIG. 6*c* illustrates a top view of the fitment of the present invention.

Also, FIG. 6*c* illustrates a top view of the fitment 20 of the present invention. As illustrated, the fitment base 36 is shaped in the form of an eye in this embodiment. Various other shapes of the fitment 20 are, of course, possible. This embodiment provides for a simpler and better seal of the fitment base 36 to the plastic film sheets comprising the body 12 of the beverage container 10.

Figure 7:
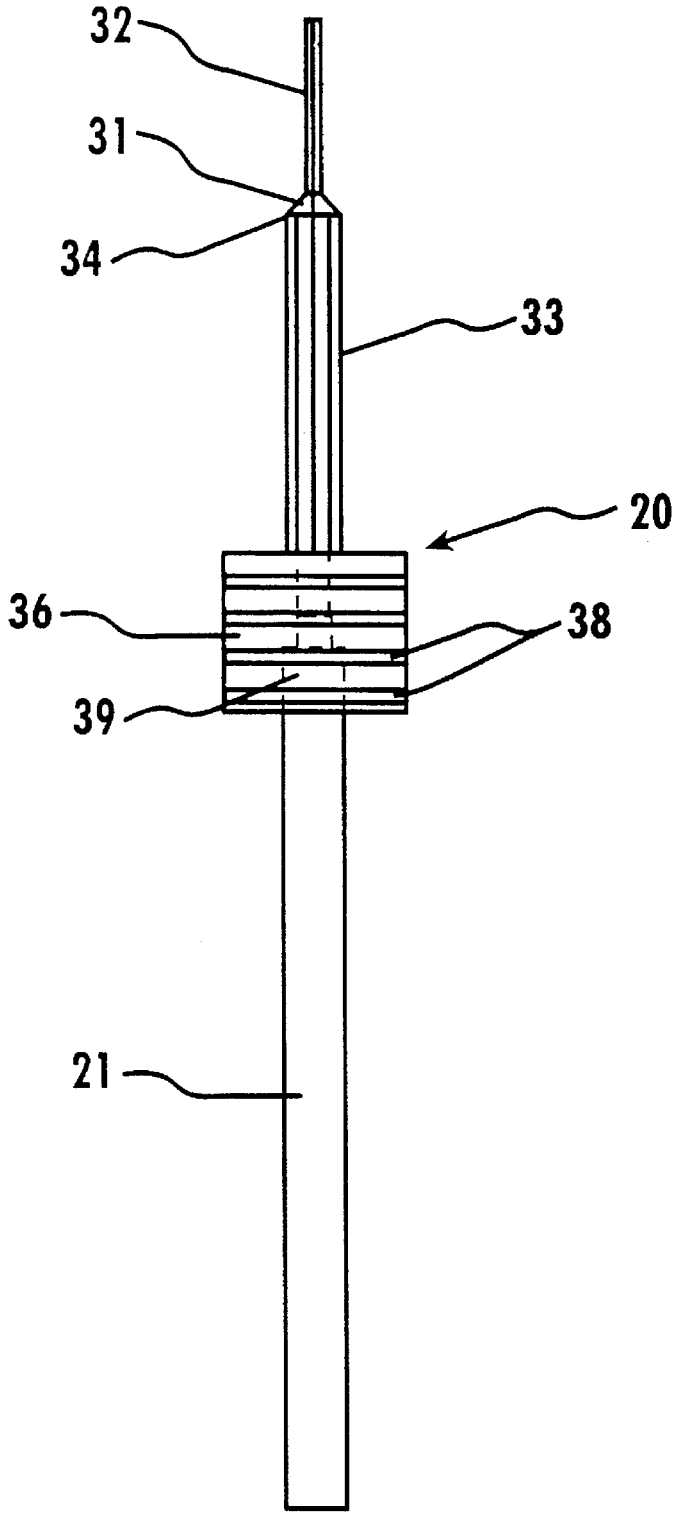
FIG. 7 illustrates a drink tube and fitment of the present invention.

FIG. 7 further illustrates an embodiment of the drink tube 21 and fitment 20 of the present invention. The drink tube 21 has a length approximately equal to the height of the body 12 of the beverage container 10. The fitment 20 also has a molded internal tube holder 39 to securely hold the drink tube 21 and to keep it in place against the fitment 20. This arrangement prevents the drink tube 21 from separating from the fitment 20, thereby avoiding the rendering of the drink tube 21 as unusable. Also, the drink tube 21 extends from the fitment 20, being disposed within the beverage container 10, down to the bottom of the beverage container 10 so as to facilitate dispensing of the complete amount of the beverage 30.

The dispensing of the beverage 30 is accomplished by separating the tabs 22, 24 to open the fitment 20. In an embodiment, the beverage 30 may then be dispensed by applying suction to the sipper 33. Also, squeezing the body 12 would force the beverage 30 out through the sipper 33. In another embodiment, the beverage 30 may be dispensed by gravity flow by inverting the container 10. This method of dispensing is preferably used in an embodiment of the container not having a drink tube 21.

A brief description of the process of manufacturing the container 10 described above follows. The beverage container 10 generally comprises three components. The first component is the container body 12 having enough structural strength to enable the container 10 to stand on its own. The second component is the fitment 10. Thirdly, the drink tube 21 is provided which extends from the fitment 20 into the container 10.

The first component, the stand-up container 10, is produced from preprinted rolls of polymeric film suitable for the particular application and beverage to be stored. The second component, the fitment 20, is injection molded and also pre-assembled to the third component, the drink tube 21, in an automated process. In addition, the container 12 component and the combined fitment 20 and drink tube 21 components are assembled in a known form, fill and seal process. A brief general description of which follows.

The first step of the process is to provide a roll stock film of the polymeric type. The film is unwound and tensioned to keep it taut. Also, an edge guide is used for the proper measurement and forming of the container. The film is then folded to form gussets which are used to provide structural strength to the container. The gussets are then sealed and side seams are manufactured. Severing the film and transferring the formed container to a fill and fitment sealer station follows in the process. The next step is to clamp, open and expand the container in preparation for filling it with the beverage. Once this is done, the container is filled with the appropriate beverage. The fitment is placed at the top of the container, and the container is stretched around the fitment. The fitment is then sealed to the container film. Further, the top of the container is sealed. The next step is to seal the break-off end at the top of the container. The peelable seal is manufactured having a long tab and a short tab, and the break-off end tab is preferably sealed to the long tab. Once the container reaches this point, the process is substantially completed. The completed package is then discharged to accumulate on a conveyor for subsequent packaging in separate or multiple shipping packages, i.e., a six-pack of beverage containers.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications may be covered by the appended claims.

We claim:

1. A container for housing and dispensing a liquid comprising:

a body having a top and a bottom, the body being defined by substantially flexible walls defining a chamber, the body further comprising a first tab and a second tab disposed at the top of the body;

a fitment, fusion sealed near the top of the body; and a drink tube secured to the fitment and extending from the fitment into the chamber of the body, said tabs enclosing said fitment.

2. The container of claim 1 wherein the walls of the body have gussets.

3. The container of claim 1 wherein the tabs are of unequal size.

4. The container of claim 1 wherein the tabs have a peelable seal therebetween.

5. The container of claim 4 wherein an enclosure surrounding the fitment is formed by the walls and is defined by the peelable seal and the fusion seal of the fitment.

6. The container of claim 1 wherein the body is constructed from a material selected from the group consisting of: plastic and foil.

7. The container of claim 1 wherein the body is constructed from preprinted rolls of polymeric film.

8. The container of claim 7 wherein the film further includes an additive selected from the group consisting of: polyester, polypropylene, nylon and polyamide.

9. The container of claim 1 wherein the fitment is injection molded.

10. The container of claim 1 wherein the fitment is fusion sealed by heat hermetically to the body.

11. The container of claim 1 wherein the fitment comprises energy-directing sealing ridges to further prevent the fitment from being separated from the body after fusion sealing the fitment to the body.

12. The container of claim 1 wherein the fitment has internal molded means for securely holding the drink tube.

13. The container of claim 1 wherein the fitment comprises means for opening the fitment to permit fluid flow of the liquid from the body via the drink tube and the fitment after opening the fitment.

14. The container of claim 1 wherein the fitment further includes means for opening the fitment sealed to a tab on the body.

15. A container for housing and dispensing a liquid comprising:

a body having a top and a bottom, the body being defined by substantially flexible walls defining a chamber, the body further comprising a first tab and a second tab disposed at the top of the body;

a fitment, fusion sealed near the top of the body, the fitment includes means for opening the fitment sealed to one of the tabs, the means for opening the fitment including a break-off end of the fitment constructed and arranged so that separating the tabs also separates the break-off end from the fitment to produce an opening in the fitment; and a tube secured to the fitment and extending from the fitment into the chamber of the body.

16. The container of claim 15 wherein the break-off end remains sealed to the tab after separating from the fitment.

17. A container for housing and dispensing a liquid comprising:

a body having a top and a bottom, the body being defined by substantially flexible walls defining a chamber, the body further comprising a first tab and a second tab disposed at the top of the body; and a fitment, fusion sealed near the top of the body including a removable means for opening the fitment, the removable means being sealed to one of the tabs, said tabs enclosing said fitment.

18. A method of dispensing a liquid comprising the steps of: providing a fluid in a container having tabs, a tube secured to a fitment, the fitment having removable means for providing access to the fluid, said tabs enclosing said fitment;

separating the tabs so that the removable means simultaneously separates from the fitment for providing access to the fluid; and dispensing the fluid through the fitment by applying suction thereto.

19. The method of claim 18 wherein the dispensing step is defined by inverting the container so that the fluid flows by gravity through the means for access.

* * * * *